US009004489B2

(12) United States Patent
Imai

(10) Patent No.: US 9,004,489 B2
(45) Date of Patent: Apr. 14, 2015

(54) MEDIUM CONVEYANCE DEVICE AND IMAGE FORMATION APPARATUS

(71) Applicant: Oki Data Corporation, Tokyo (JP)

(72) Inventor: Manabu Imai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/162,817

(22) Filed: Jan. 24, 2014

(65) Prior Publication Data

US 2014/0210162 A1 Jul. 31, 2014

(30) Foreign Application Priority Data

Jan. 28, 2013 (JP) ..... 2013-013439

(51) Int. Cl.
*B65H 5/06* (2006.01)
*G03G 15/00* (2006.01)

(52) U.S. Cl.
CPC ..... *G03G 15/6529* (2013.01); *B65H 5/068* (2013.01)

(58) Field of Classification Search
CPC .. B65H 2301/331; B65H 9/006; B65H 5/062; B65H 2404/7231; B65H 2404/142; B65H 2404/143; B65H 2404/144
USPC ..... 271/242, 274, 273
See application file for complete search history.

(56) References Cited

U.S. PATENT DOCUMENTS

2012/0031565 A1* 2/2012 Yokoyama et al. ..... 156/538

FOREIGN PATENT DOCUMENTS

| | | | |
|---|---|---|---|
| JP | 2000-118780 | A | 4/2000 |
| JP | 2001-088975 | A | 4/2001 |
| JP | 2004-083203 | A | 3/2004 |
| JP | 2004-250174 | A | 9/2004 |

* cited by examiner

*Primary Examiner* — Michael McCullough
(74) *Attorney, Agent, or Firm* — Marvin A. Motsenbocker; Mots Law, PLLC

(57) ABSTRACT

A medium conveyance device includes a pressed member, a first retention member retaining the pressed member and including a first bias-member retention portion, a press member provided facing the pressed member, a second retention member being provided movable relative to the first retention member and retaining the press member wherein the second retention member includes a second bias-member retention portion, and a bias member provided between the first bias-member retention portion and the second bias-member retention portion and supported at one end thereof by the first bias-member retention portion and at another end thereof by the second bias-member retention portion, thereby pressing the press member against the pressed member.

20 Claims, 11 Drawing Sheets

MEDIUM CONVEYANCE DEVICE AND IMAGE FORMATION APPARATUS

CROSS REFERENCE TO RELATED APPLICATIONS

This application claims priority based on 35 USC 119 from prior Japanese Patent Application No. 2013-013439 filed on Jan. 28, 2013, entitled "MEDIUM CONVEYANCE DEVICE AND IMAGE FORMATION APPARATUS", the entire contents of which are incorporated herein by reference.

BACKGROUND OF THE INVENTION

1. Field of the Invention

This disclosure relates to a medium conveyance device and an image formation apparatus.

2. Description of Related Art

Conventionally, an image formation apparatus, such as a printer (used as an example herein), a copier, a facsimile machine, or a multi-purpose machine includes an image formation unit, an LED head, a transfer roller, a fixation device, a sheet cassette, and the like. The image formation unit has a photosensitive drum, a charge roller, a development roller, a development blade, a toner supply roller, a cleaning blade, a toner cartridge, and the like. Toner is contained in the toner cartridge, and sheets are contained in the sheet cassette.

In the image formation unit, the surface of the photosensitive drum is uniformly charged by the charge roller and is exposed to light by the LED head, and thereby an electrostatic latent image is formed on the photosensitive drum. Then, the toner supply roller supplies the development roller with toner supplied from the toner cartridge to a main body of the image formation unit, and the toner on the development roller is formed into a thin film by the development blade. Then, the toner on the development roller is attached to the electrostatic latent image on the photosensitive drum, thereby developing the electrostatic latent image and forming a toner image on the photosensitive drum.

A sheet picked up from the sheet cassette is separated one by one by a pair of sheet-feed rollers and is corrected for its skew. Thereafter, the sheet is fed to a transfer area between the photosensitive drum and the transfer roller, and the transfer roller transfers the toner image onto the sheet.

Then, the sheet having the toner image transferred thereon is fed to the fixation device which fixes the toner image to the sheet, and thus, an image is formed. The sheet having the image formed thereon is ejected to the outside of the main body of the printer, i.e., outside of the apparatus main body.

To correct the skew of a sheet picked up from the sheet cassette, a roller conveyance mechanism (a medium conveyance device) is provided on a sheet conveyance route. This roller conveyance mechanism includes components such as a registration-roller pair including a registration roller (a first roller) and a pressure roller (a second roller) provided facing the registration roller (see, for example, Japanese Patent Application Publication No. 2004-83203).

SUMMARY OF THE INVENTION

In the conventional roller conveyance mechanism, however, a spring (a bias member) configured to press the pressure roller against the registration roller with a predetermined bias force has to be provided on the pressure roller side. This hinders the roller conveyance mechanism from being reduced in size. As a result, the printer cannot be reduced in size.

An object of an embodiment of the invention is to provide a medium conveyance device and an image formation apparatus which are reduced in size.

An aspect of the invention is a medium conveyance device that includes: a pressed member; a first retention member retaining the pressed member and including a first bias-member retention portion; a press member provided facing the pressed member; a second retention member being provided movable relative to the first retention member and retaining the press member, wherein the second retention member includes a second bias-member retention portion; and a bias member provided between the first bias-member retention portion and the second bias-member retention portion and supported at one end of the bias member by the first bias-member retention portion and at another end of the bias member by the second bias-member retention portion, thereby pressing the press member against the pressed member.

According to the above aspect of the invention, the bias member is provided between the first and second bias-member retention portions with its one end retained by the first bias-member retention portion of the first retention member and the other end retained by the second bias-member retention portion of the second retention member. Thus, the structure of the medium conveyance device can be simplified. Moreover, it can be ensured that a bias force of the bias member is transmitted to the press member via the second retention member, allowing a sufficient press force necessary for conveying a medium to be generated.

Furthermore, the structure of the medium conveyance device can be simplified for its part outward of the press member. As a result, the medium conveyance device can be reduced in size, which in turn can reduce the size of the image formation apparatus.

DETAILED DESCRIPTION OF EMBODIMENTS

Figure 1:
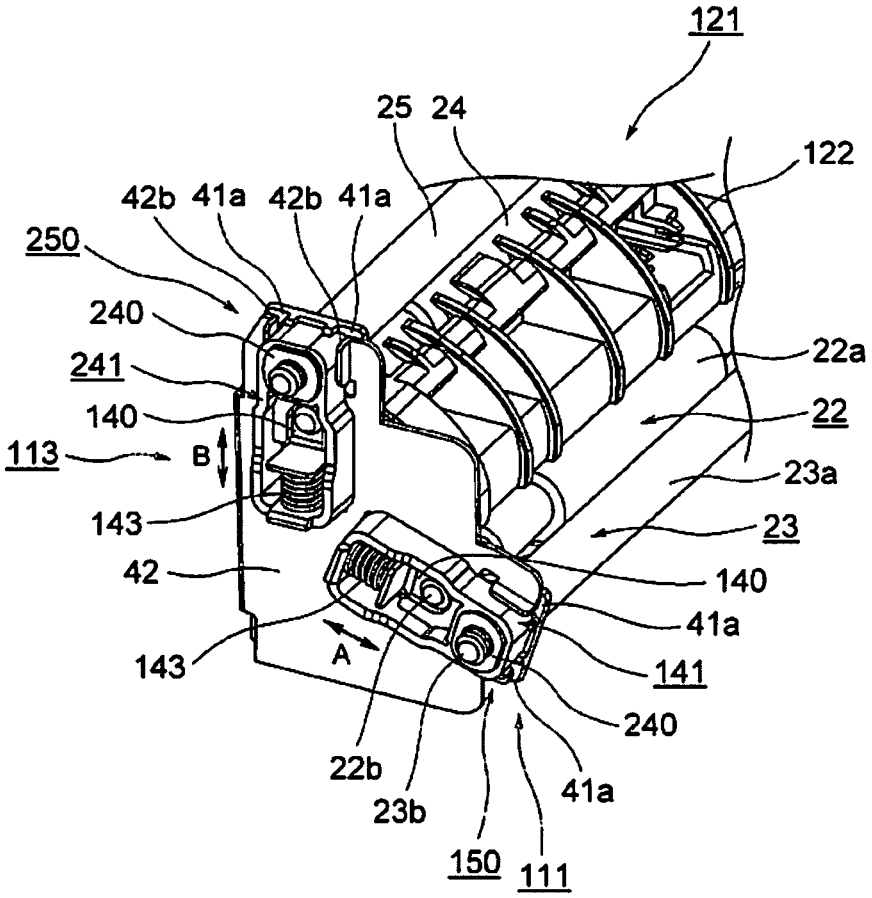
FIG. 1 is a perspective view showing a roller conveyance unit of a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of the invention are described in detail below with reference to the drawings. As an image formation apparatus, a printer is taken as an example and described.

Figure 2:
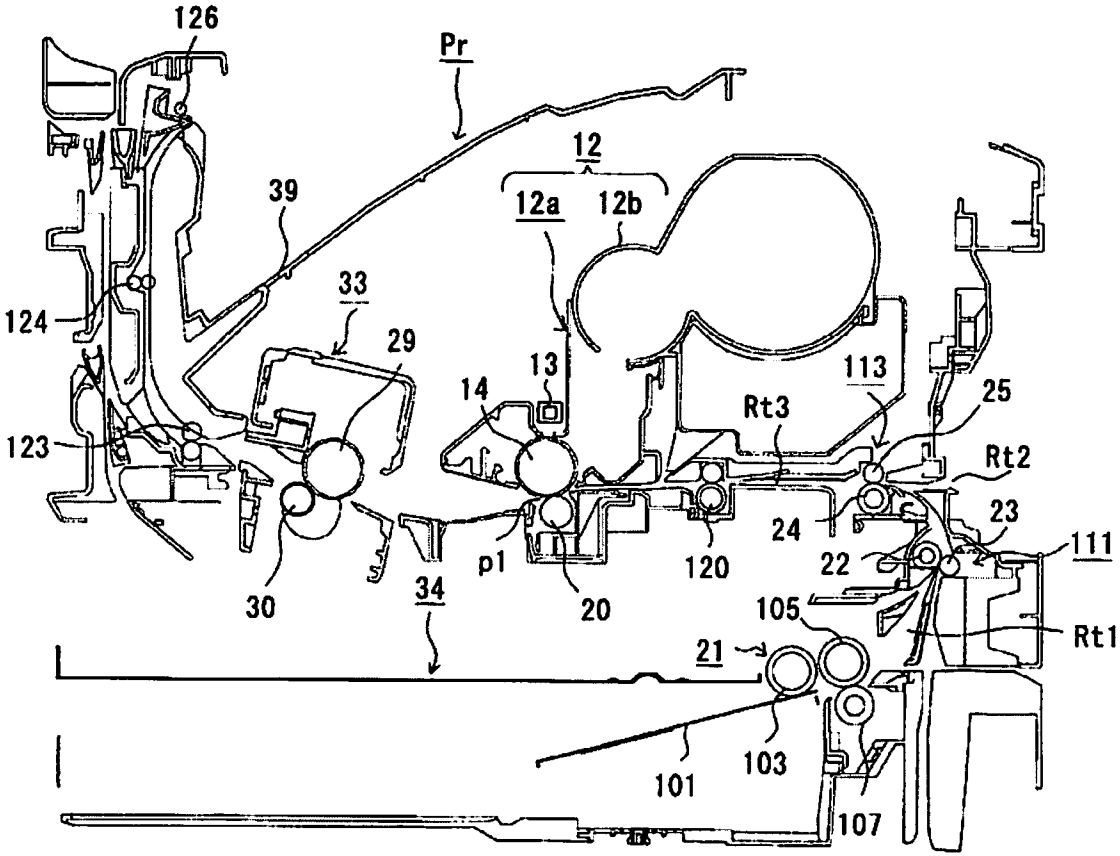
FIG. 2 is a schematic diagram of a printer of the first embodiment of the invention.

FIG. 2 is a schematic diagram of a printer of a first embodiment of the invention.

In FIG. 2, Pr denotes the printer, and printer Pr includes components such as image formation unit 12 (an image carrier) in which photosensitive drum 14 is provided, LED head 13 (an exposure device) being provided for image formation unit 12 and facing photosensitive drum 14, transfer roller 20 (a transfer member) being provided for image formation unit 12 and facing photosensitive drum 14, and fixation device 33.

Image formation unit 12 includes image-formation-unit main body 12*a*, which is a main body of image formation unit 12, and toner cartridge 12*b* (a developer container) provided attachable to and detachable from image-formation-unit main body 12*a* and configured to contain toner (developer). Besides photosensitive drum 14, image formation unit 12*a* has provided therein a charge roller (a charge device), a development roller (a developer carrier), a development blade (a developer restriction member), a toner supply roller (a developer supply member), a cleaning blade (a cleaning member), and the like (none of which is shown).

In image formation unit 12, the surface of photoconductive drum is uniformly charged by the charge roller and is exposed to light by LED head 13, and thereby an electrostatic latent image (a latent image) is formed on photosensitive drum 14. Then, the toner supply roller supplies the development roller with toner supplied from toner cartridge 12*b* to image-formation-unit main body 12*a*. The toner on the development roller is formed into a thin film by the development blade. Then, the toner on the development roller is attached to the electrostatic latent image on photosensitive drum 14, thereby developing the electrostatic latent image and forming a toner image (or a developer image) on photosensitive drum 14.

In addition, sheet cassette 34 (a first medium stacker or a medium container) is provided in a lower portion of the main body of printer Pr, i.e., the apparatus main body, such that sheet cassette 34 can be inserted into, and taken out of, the apparatus main body. Sheets (media) are stacked on medium stacker plate 101 that is swingably provided inside sheet cassette 34, and the sheets are thereby contained in sheet cassette 34.

First medium pickup portion 21 is configured to pick up a sheet one by one and is provided on a pickup side, i.e., a front end portion, of sheet cassette 34. First medium pickup portion 21 is provided such that it presses a leading edge of a sheet raised to a predetermined height by the turning of medium stacker plate 101. First medium pickup portion 21 includes components such as pickup roller 103 for picking up a sheet, feed roller 105 (a first discrimination roller or a feed mechanism) configured to separate the sheet picked up by pickup roller 103 and supply the sheet to medium conveyance route Rt1 one by one, and retard roller 107 (a second discrimination roller or a retard mechanism). Feed roller 105 and retard roller 107 form a discrimination device and a sheet-feed roller pair.

Further, a manual sheet feeder (not shown) (a second medium stacker) is provided in a side portion of the apparatus main body such that the manual sheet feeder is swingable relative to the apparatus. The manual sheet feeder includes a manual tray on which to stack sheets and a second medium pickup portion having the same structure as first medium pickup portion 21. The manual sheet feeder is configured to pick up a sheet in the manual tray and supply it to medium conveyance route Rt2.

Then, first roller conveyance mechanism 111 (a first medium conveyance device) is provided on medium conveyance route Rt1 at a position downstream of first medium pickup portion 21. Second roller conveyance mechanism 113 (a second medium conveyance device) is provided downstream of first roller conveyance mechanism 111. First roller conveyance mechanism 111 stops a sheet picked up by first medium pickup portion 21 and supplied to medium conveyance route Rt1, and thereby corrects a skew of the sheet. Then, first roller conveyance mechanism 111 conveys and supplies the sheet to medium conveyance route Rt2. Second roller conveyance mechanism 113 stops a sheet picked up by the second pickup portion and supplied to medium conveyance route Rt2, and thereby corrects a skew of the sheet. Then, second roller conveyance mechanism 111 conveys and supplies the sheet to medium conveyance route Rt3.

Note that while a sheet supplied from sheet cassette 34 is being conveyed, no sheet is supplied from the manual sheet feeder to medium conveyance route Rt2. Moreover, a sheet corrected for its skew by first roller conveyance mechanism 111 is not corrected for its skew again by second roller conveyance mechanism 113 upon arrival at second roller conveyance mechanism 113, and is conveyed and supplied to medium conveyance route Rt3.

First roller conveyance mechanism 111 includes registration roller 22 (a drive roller, a first roller, or a pressed member) configured to be rotated by a conveyance motor (not shown) which is a medium-conveyance drive portion. First roller conveyance mechanism 111 also includes pressure roller 23 (a driven roller, a second roller, or a press member) provided facing registration roller 22 and movable toward and away from registration roller 22 configured to rotate by following the rotation of registration roller 22 when in contact with registration roller 22. First roller conveyance mechanism 111 includes components such as spring 143 (a bias member) configured to press pressure roller 23 against registration roller 22. While registration roller 22 is rotatably fixed at a predetermined position on frame member 42 to be described later (FIG. 1), pressure roller 23 is provided such that it can slightly move on a line connecting the axis of registration roller 22 and the axis of pressure roller 23 (a line normal to registration roller 22 and pressure roller 23). When a sheet passes through registration roller 22 and pressure roller 23, pressure roller 23 moves away from registration roller 22 according to the thickness of the sheet. Registration roller 22 and pressure roller 23 form a first registration-roller pair (a skew correction roller pair).

Second roller conveyance mechanism 113 includes registration roller 24 (a drive roller, a first roller, or a pressed member) configured to be rotated by the conveyance motor. Second roller conveyance mechanism 113 also includes pressure roller 25 (a driven roller, a second roller, or a press member) provided facing registration roller 24 and movable toward and away from registration roller 24 and configured to rotate by following the rotation of registration roller 24 when in contact with registration roller 24. Second roller conveyance mechanism 113 includes components such as spring 143 (a bias member) configured to press pressure roller 25 against registration roller 24. While registration roller 24 is rotatably fixed at a predetermined position on frame member 42, pressure roller 25 is provided such that it can slightly move on a line connecting the axis of registration roller 24 and the axis of pressure roller 25. When a sheet passes through registration roller 24 and pressure roller 25, pressure roller 25 moves away from registration roller 24 according to the thickness of the sheet. Registration roller 24 and pressure roller 25 form a second registration-roller pair (a skew-correction roller pair).

Registration roller 22, 24 is formed by coating a shaft made of metal which is a conductive material and is stainless steel in this embodiment, with insulation rubber as an insulation layer. Pressure rollers 23, 25 are formed with a roller made of metal which is a conductive material and is stainless steel in this embodiment.

A sheet conveyed along medium conveyance routes Rt1, Rt2 is supplied to medium conveyance route Rt3, where a conveyance-roller pair 120 provided thereon feeds the sheet to transfer area p1 between photosensitive drum 14 and transfer roller 20. In transfer area p1, a toner image on photosensitive drum 14 is transferred onto the sheet.

Fixation device 33 is provided on medium conveyance route Rt3 at a position downstream of transfer area p1. Fixation device 33 includes fixation roller 29 (a first fixation roller) internally having a heating element (not shown), such as a halogen lamp, and backup roller 30 (a second fixation roller) provided facing fixation roller 29. The toner image on the sheet is heated and pressed and is thereby fixed onto the sheet by fixation roller 29 and backup roller 30. Thus, an image is formed.

Then, conveyance-roller pairs 123, 124 and ejection-roller pair 126 are provided on medium conveyance route Rt3 at a position downstream of fixation device 33. The sheet on which the image is formed is further conveyed by roller pairs 123, 124, ejected to the outside of the apparatus main body by roller pair 126, and stacked on output tray 39.

Note that roller pairs 120, 123, 124, and 126 respectively form third to sixth roller conveyance mechanisms (third to sixth medium conveyance devices) with their springs (not shown) and the like.

Next, a description is given of a roller conveyance unit formed by first and second roller conveyance mechanisms 111, 113.

Figure 3:
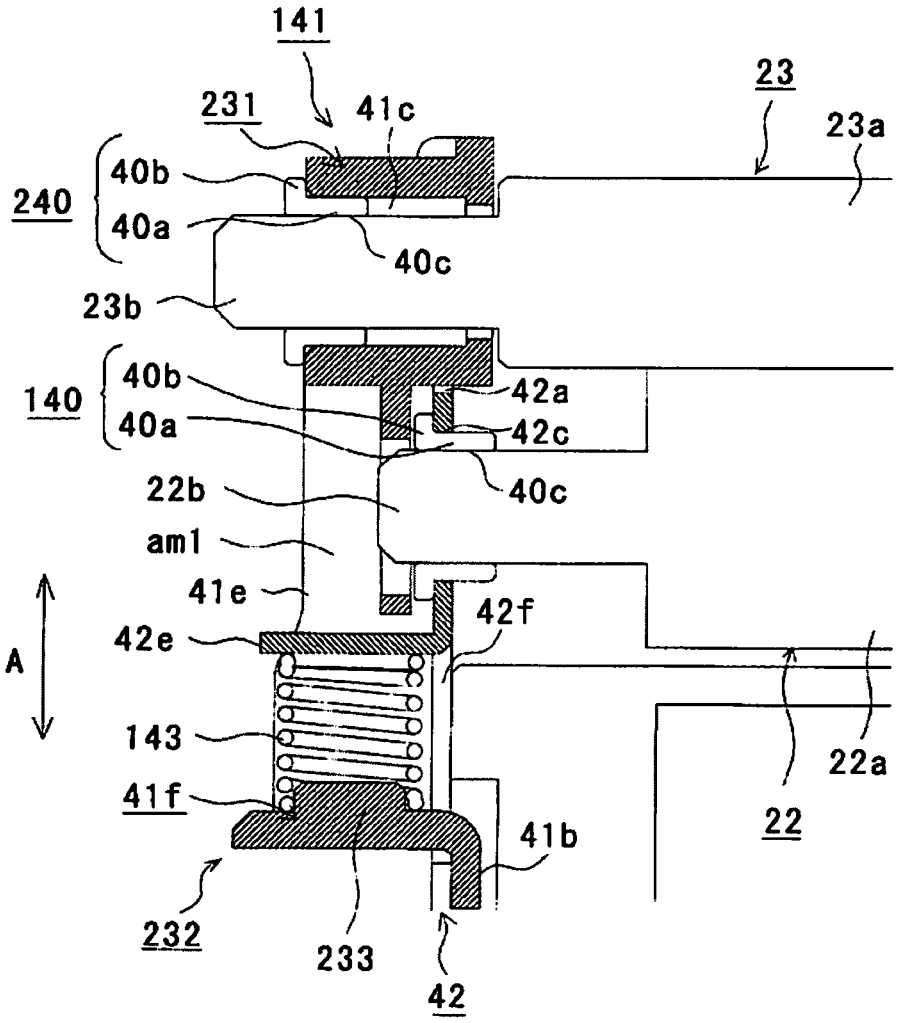
FIG. 3 is a sectional view showing a main part of a first roller conveyance mechanism of the first embodiment of the invention.
Figure 4:
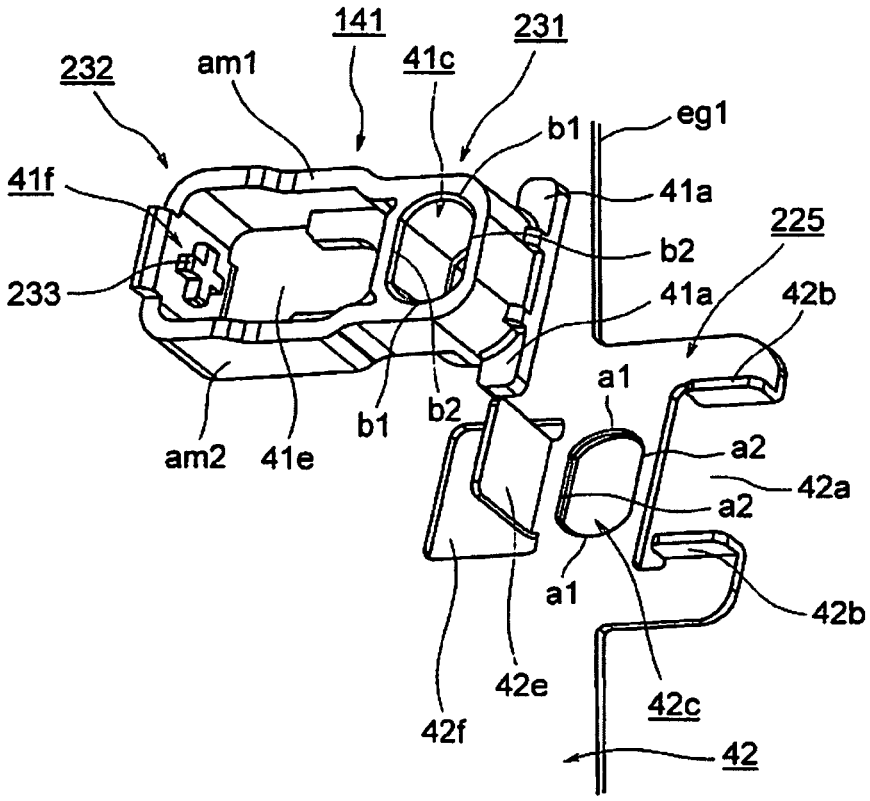
FIG. 4 is an exploded perspective view showing the main part of the first roller conveyance mechanism of the first embodiment of the invention.
Figure 5:
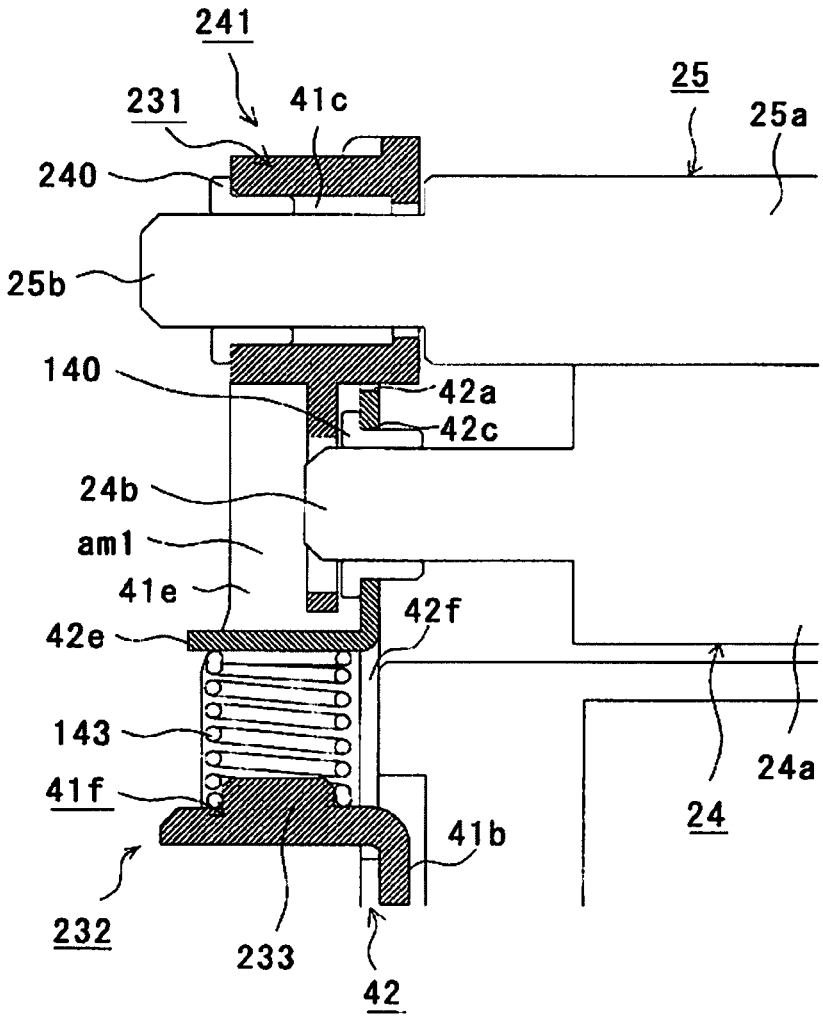
FIG. 5 is a sectional view showing a main part of a second roller conveyance mechanism of the first embodiment of the invention.
Figure 6:
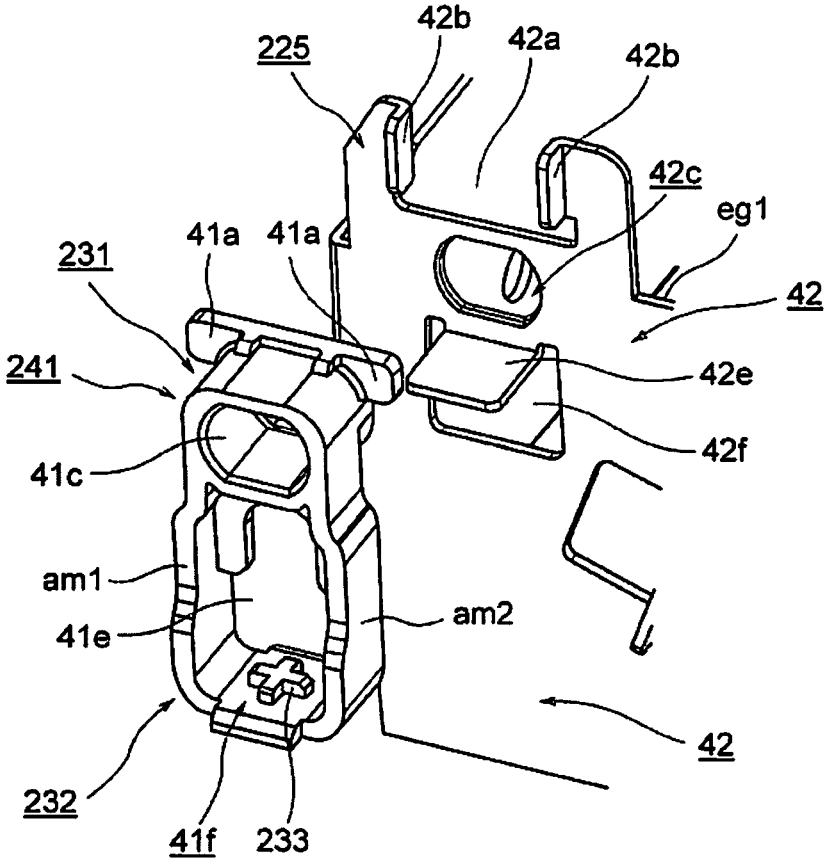
FIG. 6 is an exploded perspective view showing the main part of the second roller conveyance mechanism of the first embodiment of the invention.

FIG. 1 is a perspective view showing the roller conveyance unit of the first embodiment of the invention, FIG. 3 is a sectional view showing a main part of the first roller conveyance mechanism of the first embodiment of the invention, FIG. 4 is an exploded perspective view showing the main part of the first roller conveyance mechanism of the first embodiment of the invention, FIG. 5 is a sectional view showing a main part of the second roller conveyance mechanism of the first embodiment of the invention, and FIG. 6 is an exploded perspective view showing the main part of the second roller conveyance mechanism of the first embodiment of the invention.

In these drawings, reference numeral 121 denotes the roller conveyance unit, 122 denotes inner guides forming medium conveyance route Rt2 (FIG. 2), 111 and 113 denote the first and second roller conveyance mechanisms, respectively, 22 and 24 denote registration rollers, 23 and 25 denote pressure rollers, 42 denotes the frame member (a first retention member or a drive-roller retention portion) formed by a plate which is a conductive material, configured to directly retain registration rollers 22, 24, and indirectly retain pressure rollers 23, 25.

Moreover, reference numeral 140 denotes a bearing (a first support member) configured to allow a corresponding one of registration rollers 22, 24 to be rotatably supported by frame member 42. Reference numerals 141 and 241 are bearing holders (second retention members or driven roller retention portions), configured to retain pressure rollers 23, 25, respectively. Bearing holder 141 is movable and slidable relative to frame member 42 along a line connecting the axis of registration roller 22 and the axis of pressure roller 23 in directions denoted by arrow A (in this embodiment, a direction in which pressure roller 23 moves closer to registration roller 22 and a direction in which pressure roller 23 moves away from registration roller 22). Bearing holder 241 is movable and slidable relative to frame member 42 along a line connecting the axis of registration roller 24 and the axis of pressure roller 25 in directions denoted by arrow B (in this embodiment, a direction in which pressure roller 25 moves closer to registration roller 24 and a direction in which pressure roller 25 moves away from registration roller 24).

Moreover, reference numeral 143 denotes a spring (the bias member) configured to bias bearing holders 141, 241 with a predetermined bias force so that pressure rollers 23, 25 move closer to registration rollers 22, 24 and thereby presses pressure roller 23 against registration roller 22 or presses pressure roller 25 against registration roller 24. Reference numeral 240 denotes a bearing (a second support member) configured to allow pressure roller 23, 25 to be rotatably supported by corresponding bearing holder 141, 241.

Since spring 143 biases bearing holders 141, 241 in directions in which pressure rollers 23, 25 move closer to registration rollers 22, 24, respectively, registration roller 22 is located between spring 143 and pressure roller 23 on the line connecting the axis of registration roller 22 and the axis of pressure roller 23, and registration roller 24 is located between spring 143 and pressure roller 25 on the line connecting the axis of registration roller 24 and the axis of pressure roller 25.

Pressure roller unit 150 (a first press unit) is formed by pressure roller 23, bearing holder 141, spring 143, and bearing 240. Pressure roller unit 150 moves relative to frame member 42 in the arrow-A directions according to the thickness of a sheet passing through registration roller 22 and pressure roller 23. Similarly, pressure roller unit 250 (a second press unit) is formed by pressure roller 25, bearing holder 241, spring 143, and bearing 240. Pressure roller unit 250 moves relative to frame member 42 in the arrow-B directions according to the thickness of a sheet passing through registration roller 24 and pressure roller 25.

Frame member 42, bearings 140, 240, bearing holders 141, 241, spring 143, and the like are provided at each end of a set of registration rollers 22, 24 and pressure rollers 23, 25. A gear (not shown) is provided at one end of each registration roller 22, 24, and a rotation transmission system (not shown) is provided between the gear and the conveyance motor.

Registration rollers 22, 24 include roller main body portions 22*a*, 24*a* and shaft end portions 22*b*, 24*b* protruding from ends of corresponding roller main body portions 22*a*, 24*a*, respectively, and are rotatably supported at shaft end portions 22*b*, 24*b* by bearings 140. Similarly, pressure rollers 23, 25 include roller main body portions 23*a*, 25*a* and shaft end portions 23*b*, 25*b* protruding from ends of corresponding roller main body portions 23*a*, 25*a*, respectively, and are rotatably supported at shaft end portions 23*b*, 25*b* by bearings 240.

Bearings 140, 240 are each a sliding bearing including tubular portion 40*a* and flange portion 40*b* protruding outward radially from an end of tubular portion 40*a*. An outer circumferential surface of each of shaft end portions 22*b* to 25*b* frictionally slides on an inner surface of support hole 40*c* formed by penetrating tubular portion 40*a*.

Bearing holders 141, 241 are retained at their one ends by frame member 42 so as not to rotate relative to frame member 42 along with the rotation of registration roller 22 and the rotation of pressure roller 23, respectively. For this reason, bearing holder retention portion 225 is formed at each predetermined position on frame member 42, protruding from edge portion eg1. Bearing holder retention portion 225 includes portions such as recessed portion 42*a* (a first holder lock portion) formed by partially cutting away bearing holder retention portion 225 by a predetermined depth to accommodate and lock an end of corresponding bearing holders 141, 241, and tabs 42*b* (a holder-gripper pair or a rotation restrictor) each formed by raising a side edge of recessed portion 42*a*. Tabs 42*b* sandwich bearing holders 141, 241 at its sides such that bearing holders 141, 241 are slidably gripped, and thereby restrict the rotation of bearing holders 141, 241.

In addition, a through-hole 42*c* (a pressed-member support portion) configured to support registration roller 22 is formed in frame member 42 at a position adjacent to recessed portion 42*a* and shifted therefrom inward (toward the other end of bearing holders 141, 241). Bearing 140 is fitted into through-hole 42*c*. Bearing 140 is retained by frame member 42 so as not to rotate relative to frame member 42 along with the rotation of registration roller 22. For this reason, through-hole 42*c* has a racetrack shape formed by connecting two arc-shaped portions a1 with straight-line portions a2. An outer circumferential surface of each of tubular portion 40*a* and flange portion 40*b* of bearing 140 also has a racetrack shape as through-hole 42*c* does.

Spring hold-down 42*e* (a first bias-member retention portion) is formed by being cut and raised at a position adjacent to through-hole 42*c* and is shifted therefrom inward and is configured to support one end of spring 143. Lock hole 42*f* (a second holder lock portion) is configured to lock the other end of bearing holder 141, 241 and is formed at a position adjacent to spring hold-down 42*e* and is shifted inward therefrom. Spring hold-down 42*e* and lock hole 42*f* both have a rectangular shape.

Bearing holders 141, 241 are formed by a rectangular hollow body having a horizontally-long or vertically-long shape (a shape in which the line connecting the axes of registration roller 22 and pressure roller 23 runs in a long-side direction thereof). Bearing holders 141, 241 include pressure-roller support part 231 configured to support pressure roller 23 and spring accommodation part 232 configured to accommodate spring 143 therein. Then, in order for bearing holders 141, 241 not to come off from frame member 42, a pair of lock pieces 41*a* for respective tabs 42*b* is formed, protruding to the sides, in one end of bearing holders 141, 241, and lock piece 41*b* for lock hole 42*f* is formed, protruding downward, in the other end of bearing holder 141, 241. With bearing holders 141, 241 in contact with frame 42, lock pieces 41*a* are locked on an inner circumferential edge of recessed portion 42*a*, and lock piece 41*b* is locked on an inner circumferential edge of lock hole 42*f*.

The positions, sizes, and the like of recessed portion 42*a*, lock hole 42*f*, and lock pieces 41*a*, 41*b* are set so that lock pieces 41*a*, 41*b* can remain locked on frame member 42 while pressure roller unit 150 moves relative to frame member 42 in the arrow-A directions according to the thickness of a sheet passing through registration roller 22 and pressure roller 23 and while pressure roller unit 250 moves relative to frame member 42 in the arrow-B directions according to the thickness of a sheet passing through registration roller 24 and pressure roller 25.

Pressure-roller support part 231 has through-hole 41*c* (a press member support portion) and bearing 240 is fitted into this through-hole 41*c*. Bearing 240 is retained by bearing holders 141, 241 so as not to rotate relative to bearing holders 141, 241 along with the rotation of pressure rollers 23, 25. Hence, through-hole 41*c* has a racetrack shape formed by connecting two arc-shaped portions b1 with straight-line portions b2. An outer circumferential surface of each of tubular portion 40*a* and flange portion 40*b* of bearing 240 also has a racetrack shape as through-hole 41*c* does.

Spring accommodation part 232 has through-hole 41*e* so that spring hold-down 42*e* can enter bearing holders 141, 241 when bearing holders 141, 241 are attached to frame member 42. Pressure-roller support part 231 has two arms am1, am2 protruding in parallel to each other. Tip ends of respective arms am1, am2 are connected to form spring receiver 41*f* (a second bias-member retention portion) configured to support the other end of spring 143. Spring 143 is provided in a compressed state between spring hold-down 42*e* and spring receiver 41*f*, with one end of spring 143 in contact with spring hold-down 42*e* and the other end thereof in contact with spring receiver 41*f*. In this embodiment, a compression spring is used as spring 143.

With bearing holders 141, 241 being attached to frame member 42, spring hold-down 42*e* is located between through-hole 41*c* and spring receiver 42*e*, and through-hole 42*c* is located between through-hole 41*c* and spring-hold down 42*e*. In addition, in order for spring 143 not to come off, protrusion 233 of a predetermined shape, which is a cross shape in this embodiment, is formed on each of a surface of spring receiver 41*f* facing spring hold-down 42*e* and a surface of spring hold-down 42*e* facing spring receiver 41*f*.

In this way, with respect to spring hold-down 42*e*, bearing holders 141, 241 are biased from the pressure rollers 23, 25 side toward the registration rollers 22, 24 side by a bias force of spring 143. Thus, pressure rollers 23, 25 can be sufficiently pressed against registration rollers 22, 24. This eliminates the need of having the spring at a position inward of pressure rollers 23, 25 on the line connecting the axes of registration rollers 22, 24 and pressure rollers 23, 25. As a result, first and second roller conveyance mechanisms 111, 113 can be reduced in size.

Next, the operation of roller conveyance unit 121 is described. Since first and second roller conveyance mechanisms 111, 113 have the same structure, the operation of only first roller conveyance mechanism 111 is described.

Figure 7:
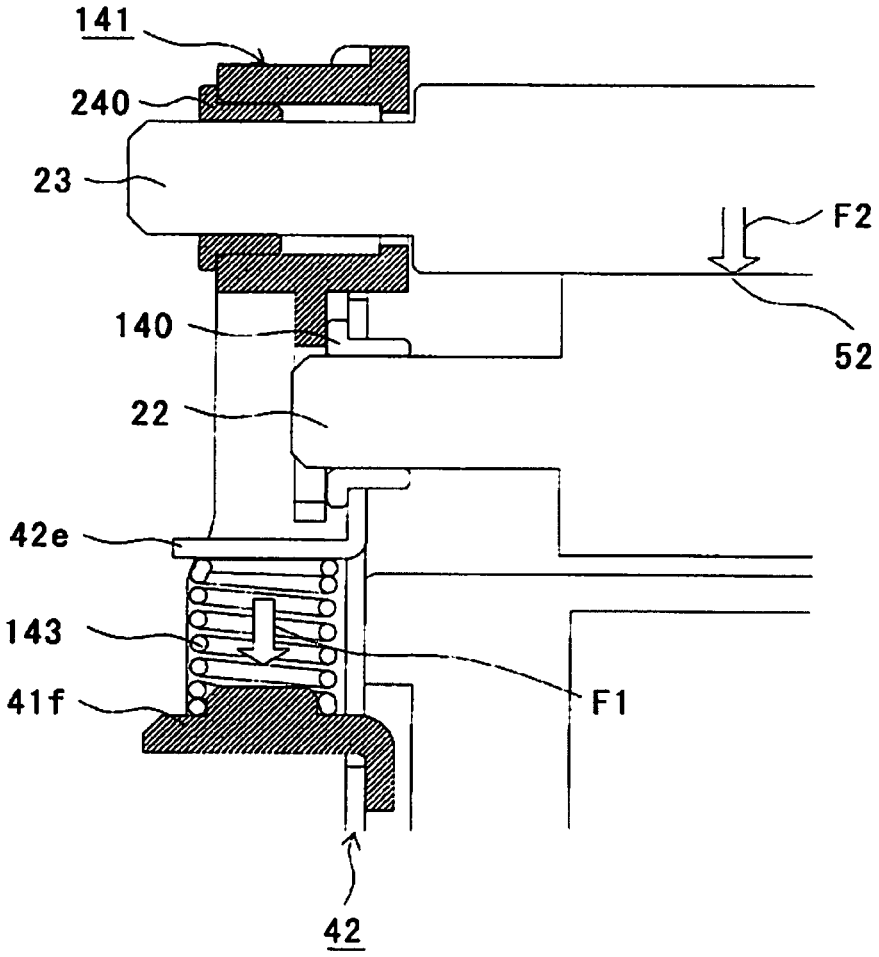
FIG. 7 is a diagram illustrating operation of the first roller conveyance mechanism of the first embodiment of the invention (part 1).
Figure 8:
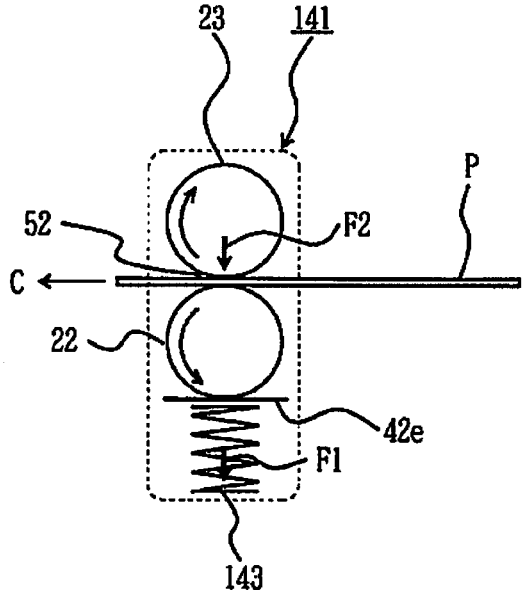
FIG. 8 is a diagram illustrating operation of the first roller conveyance mechanism of the first embodiment of the invention (part 2).

FIG. 7 is a diagram illustrating the operation of the first roller conveyance mechanism of the first embodiment of the invention (part 1), and FIG. 8 is a diagram illustrating the operation of the first roller conveyance mechanism of the first embodiment of the invention (part 2).

First, upon receipt of a print command from a host computer (not shown) which is a higher-level apparatus, printer Pr (FIG. 2) starts printing.

Then, sheet P contained in sheet cassette 34 is picked up by a pickup roller 103. In the pickup operation, the sheets are separated one by one by the discrimination device. Sheet P is conveyed to medium conveyance route Rt1, and supplied to first roller conveyance mechanism 111. Note that registration roller 22 and pressure roller 23 in first roller conveyance mechanism 111 are stopped here.

In this state, spring 143 of first roller conveyance mechanism 111 is provided in a compressed state between spring hold-down 42*e* and spring receiver 41*f*. Hence, as shown in FIG. 7, spring receiver 41*f* is under a reaction force F1 which is a bias force of spring 143 and tries to move away from spring hold-down 42*e*. With this, bearing holder 141 produces a press force F2 which corresponds to the bias force of spring 143 and is necessary to convey sheet P. Bearing holder 141 presses pressure roller 23 against registration roller 22 with this press force F2 to form nip portion 52 between registration roller 22 and pressure roller 23. Note that press force F2 is a resultant force of reaction forces F1 of springs 143 provided at respective ends of a set of registration roller 22 and pressure roller 23.

Then, when sheet P hits nip portion 52 with registration roller 22 and pressure roller 23 being stopped, a skew of sheet P is corrected.

Then, when the conveyance motor is driven, registration roller 22 and pressure roller 23 are rotated, as shown in FIG. 8, in directions indicated by the arrows. When sheet P enters nip portion 52, pressure roller 23 moves away from registration roller 22 against press force F2.

Thereby, sheet P sandwiched by registration roller 22 and pressure roller 23 at nip portion 52 receives a frictional force produced by press force F2 and is conveyed in a direction indicated by arrow C along with the rotation of registration roller 22.

In this way, in this embodiment, frame member 42 has formed therein through-hole 42*c* for supporting registration rollers 22, 24 and spring hold-down 42*e* for retaining spring 143, and bearing holders 141, 241 each has formed therein a through-hole 41*c* for supporting pressure rollers 23, 25 and spring receiver 41*f* for retaining spring 143. Spring hold-down 42*e* is provided between through-hole 42*c* and spring receiver 41*f*, and spring 143 is provided between spring hold-down 42*e* and spring receiver 41*f*. Thus, first and second roller conveyance mechanisms 111, 113 can be simplified in structure. Moreover, it can be ensured that the bias force of spring 143 is transmitted to pressure rollers 23, 25 via bearing holders 141, 241 to be able to produce sufficient press force F2 necessary for conveying sheet P.

Furthermore, spring 143 can be provided inward of registration rollers 22, 24 on the line connecting the axes of registration rollers 22, 24 and pressure rollers 23, 25. This allows a simplification of the structure of each of first and second roller conveyance mechanisms 111, 113 for a part outward of pressure rollers 23, 25. As a result, first and second roller conveyance mechanisms 111, 113 can be reduced in size, which in turn enables a size reduction of printer Pr.

Moreover, since spring 143 is provided in a compressed state between spring hold-down 42*e* and spring receiver 41*f*, the same bias force can be produced with a smaller space than the space required when the spring is provided in an extended state. Thus, first and second roller conveyance mechanisms 111, 113 can be reduced in size.

Further, the rotation of the conveyance motor is transmitted to registration rollers 22, 24 provided at each predetermined position on the frame member 42. The rotation transmitted to registration rollers 22, 24 is then transmitted to pressure rollers 23, 25 which are each respectively movable relative to frame member 42. Thus, registration roller 22, 24 and pressure roller 23, 25 can be rotated surely and stably.

Since through-hole 42*c* is located between through-hole 41*c* and spring hold-down 42*e*, bearing 140 fitted into through-hole 42*c* can be provided between bearing 240 fitted into through-hole 41*c* and spring hold-down 42*e*. Thus, registration rollers 22, 24 can be provided close to frame member 42 axially, which contributes to a further size reduction of first and second roller conveyance mechanisms 111, 113.

Next, a second embodiment of the invention is described. Note that components having the same structures as those in the first embodiment are given the same reference numerals as those used in the first embodiment, and advantageous effects offered by those components in this embodiment are the same as those offered by the first embodiment.

Figure 9:
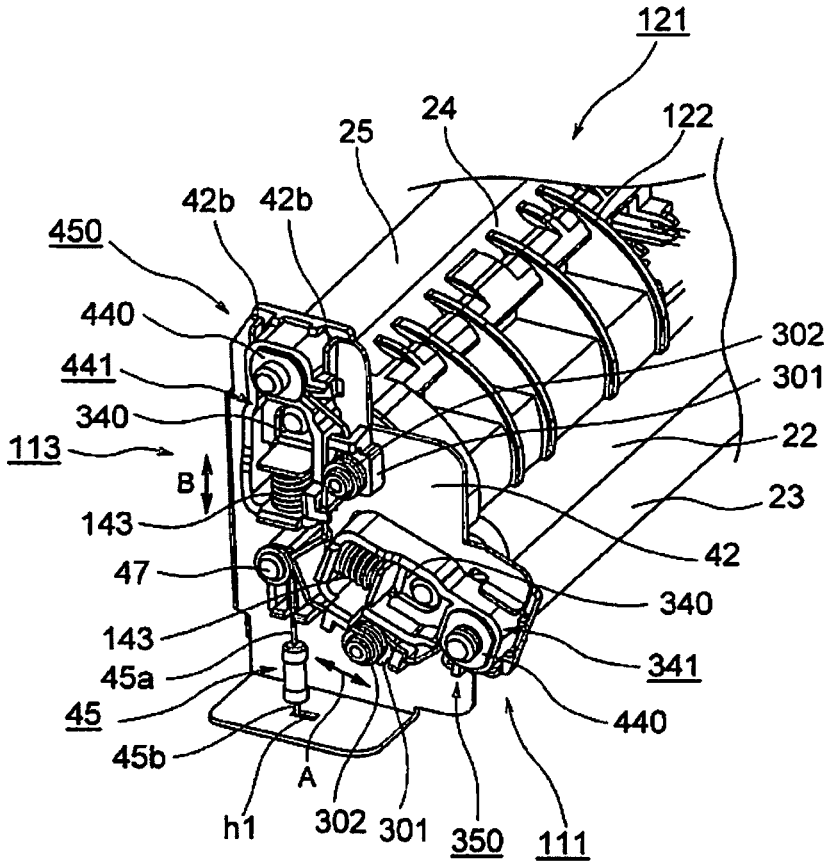
FIG. 9 is a perspective view showing a roller conveyance unit of a second embodiment of the invention.
Figure 10:
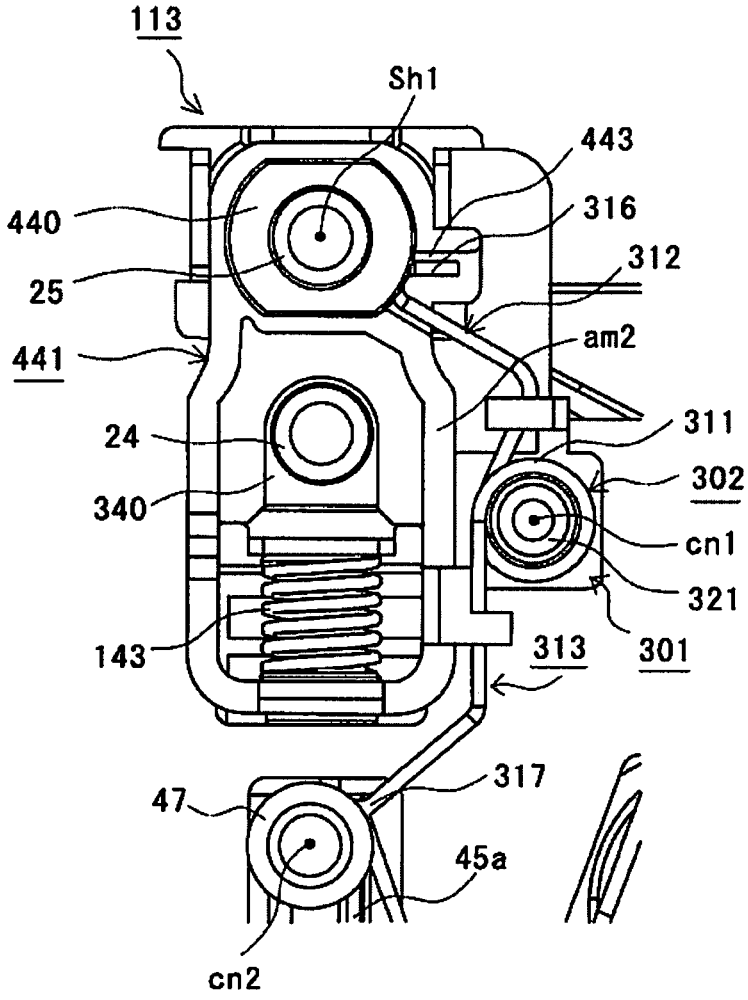
FIG. 10 is a view showing a main part of a second roller conveyance mechanism of the second embodiment of the invention.

FIG. 9 is a perspective view showing a roller conveyance unit of a second embodiment of the invention, and FIG. 10 is a view showing a main part of a second roller conveyance mechanism of the second embodiment of the invention.

In these drawings, reference numeral 121 denotes a roller conveyance unit, 122 denotes inner guides forming medium conveyance route Rt2 (FIG. 2), 111, 113 respectively denote first and second roller conveyance mechanisms (first and second medium conveyance devices), 22, 24 denote registration roller (first rollers, drive rollers, or pressed members), 23, 25 denote pressure rollers (second rollers, driven rollers, or press members), and 42 denotes a frame member (a first retention member or a drive-roller retention portion) formed by a plate which is a conductive material, configured to directly retain registration rollers 22, 24, and indirectly retain pressure rollers 23, 25.

Further, reference numeral 340 denotes a bearing (a first support member) made of a predetermined material, which is a conductive material, namely metal, in this embodiment. Bearing 340 is configured to allow registration rollers 22, 24 to be rotatably supported by frame member 42. Reference numerals 341, 441 are bearing holders (second retention members or driven-roller retention portions) configured to retain pressure rollers 23, 25.

Bearing holder 341 is movable and slidable relative to frame member 42 along a line connecting the axis of registration roller 22 and the axis of pressure roller 23 in directions indicated by arrow A. Bearing holder 441 is movable and slidable relative to frame member 42 along a line connecting the axis of registration roller 24 and the axis of pressure roller 25 in directions indicated by arrow B.

Moreover, reference numeral 143 denotes a spring (a bias member) configured to bias bearing holders 341, 441 with a predetermined bias force so that pressure rollers 23, 25 each respectively moves closer to registration rollers 22, 24 and thereby presses pressure roller 23 against registration roller 22, or presses pressure roller 25 against registration roller 24. Reference numeral 440 denotes a bearing (a second support member) made of a conductive material, namely metal, and is configured to allow pressure rollers 23, 25 to be rotatably supported respectively by bearing holders 341, 441.

Here, bearing 440 is configured to retain pressure roller 23 and is provided upstream of bearing 441 configured to retain pressure roller 25 in a medium conveyance direction. Bearing holder 441 has one end portion where bearing 440 is provided and another end portion where spring 143 is provided. Bearing holder 441 extends from the one end portion to the other end portion thereof. Similarly, bearing holder 341 has one end portion where bearing 440 is provided and another end portion where spring 143 is provided, and extends from the one end portion to the other end portion.

The distance between the other end portion of bearing holder 341 and the other end portion of bearing holder 441 is shorter than the distance between the one end portion of bearing holder 341 and the one end portion of bearing holder 441 (see FIG. 9). In other words, the other end portion of bearing holder 341 and the other end portion of bearing holder 441 face each other closely. When seen in the axial direction of rollers 22, 23, 24, 25, the other end portions of bearing holders 341, 441 are located inward of curved guides 122, i.e., located on the concave surface side of curved guides 122.

Moreover, when seen in the axial direction of rollers 22, 23, 24, 25, springs 143 provided at the respective other end portions of bearing holders 341, 441 are located inward of curved guides 122, i.e., located on the concave surface side of curved guides 122.

Pressure roller unit 350 (a first press unit) is formed by pressure roller 23, bearing holder 341, spring 143, and bearing 440. Pressure roller unit 350 moves relative to frame member 42 in the arrow-A directions according to the thickness of a sheet passing through registration roller 22 and pressure roller 23. Similarly, pressure roller unit 450 (a second press unit) is formed by pressure roller 25, bearing holder 441, spring 143, and bearing 440. Pressure roller unit 450 moves relative to frame member 42 in the arrow-B directions according to the thickness of a sheet passing through registration roller 24 and pressure roller 25.

Spring attachment portion 301 (a conductive-member support portion or a bias-member support portion) is formed at, and protrudes from, a predetermined position on bearing holders 341, 441, or in this embodiment, arm am2 of bearing holders 341, 441. Torsion spring 302 (a conductive member) is made of a conductive material, namely metal, and is attached to spring attachment portion 301. Torsion spring 302 includes portions such as coil portion 311 formed by winding wire a predetermined number of times, and first and second arm portions 312, 313 extending from the respective ends of coil portion 311. Torsion spring 302 is attached to spring attachment portion 301 by fitting coil portion 311 around columnar boss portion 321 formed in spring attachment portion 301.

One end of torsion spring 302, i.e., free end 316 at first arm portion 312, is inserted into bearing holder 441 from hole 443 formed on a side surface of bearing holder 441, and is pressed against a tubular portion (not shown) of bearing 440 with a predetermined bias force. The other end of torsion spring 302, i.e., fixed end 317 at second arm portion 313, is fixed to frame member 42 by screw 47 (a fixture member), together with lead 45*a* connected to one terminal of resistance element 45. Note that frame member 42 is insulated from fixed end 317 at second arm portion 313 and lead 45*a* by an insulator or the like.

Lead 45*b* connected to the other terminal of resistance element 45 penetrates hole h1 formed in frame member 42, extends downward, fixed to a predetermined metal portion of printer Pr (FIG. 2), e.g., a casing, and is grounded.

Note that a resistance value for bearing 440 is about $1\times10^2$ [Ω], a resistance value for resistance element 45 is about $1\times10^8$ [Ω], and a bias force with which free end 316 at first arm portion 312 is pressed against the tubular portion of bearing 440 is about 200 [gf].

Further, center cn1 of boss portion 321 of spring attachment portion 301 is located at a predetermined distance away from a virtual straight line connecting shaft center sh1 of pressure roller 25 and center cn2 of screw 47.

Next, the operation of first and second roller conveyance mechanisms 111, 113 is described. Since first and second roller conveyance mechanisms 111, 113 have the same structure, only the operation of second roller conveyance mechanism 113 is described, the operation being performed when a sheet passes through registration roller 24 and pressure roller 25.

Figure 11:
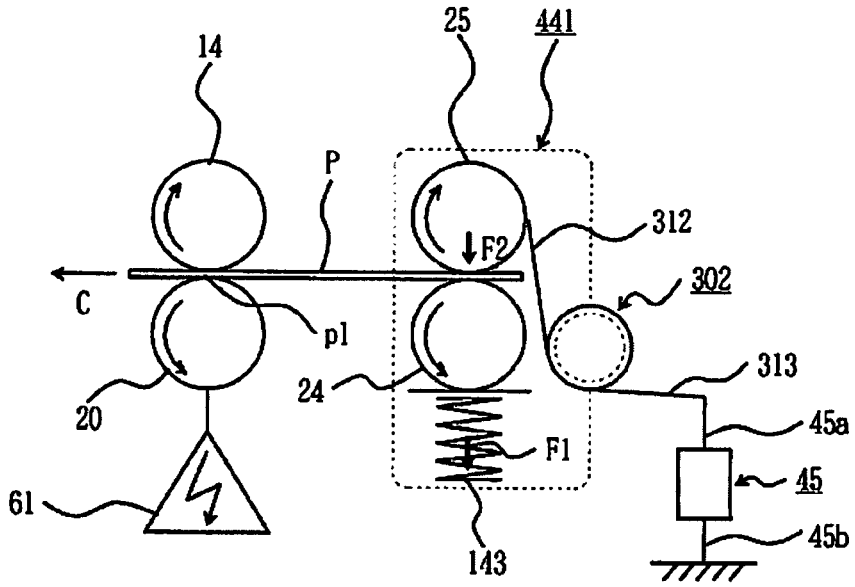
FIG. 11 is a diagram illustrating operation of the second roller conveyance mechanism of the second embodiment of the invention.

FIG. 11 is a diagram illustrating the operation of the second roller conveyance mechanism of the second embodiment of the invention.

In the drawings, reference numeral 14 denotes a photosensitive drum (an image carrier), 20 denotes a transfer roller (a transfer member), 24 denotes the registration roller, 25 denotes the pressure roller, 143 denotes the spring, and 441 denotes the bearing holder.

Sheet P picked up by first medium pickup portion 21 from sheet cassette 34 (FIG. 2) (a first medium stacker or a medium container) and supplied to medium conveyance route Rt1 is temporarily stopped by first roller conveyance mechanism 111 to be corrected for its skew, and is then supplied to second roller conveyance mechanism 113.

Then, when the leading end of sheet P reaches registration roller 24 and pressure roller 25, pressure roller 25 moves away from registration roller 24 against a bias force of spring 143 (upward in FIG. 11). In this event, spring receiver 41*f* (FIG. 3) receives a reaction force F1 which is the bias force of spring 143. Bearing holder 441 produces a press force F2 which corresponds to the bias force of spring 143 and is necessary to convey sheet P, and presses pressure roller 25 against registration roller 24 with this press force F2.

Subsequently, when the leading edge of sheet P reaches transfer area p1 between photosensitive drum 14 and transfer roller 20, a high voltage is applied to transfer roller 20 by high-voltage source 61, thereby transferring a toner image (a developer image) from photosensitive drum 14 onto sheet P. In this event, the high voltage is also applied to registration roller 24 and pressure roller 25 via sheet P. However, pressure roller 25 is supported by bearing 440 and is grounded via bearing 440, torsion spring 302, lead 45*a*, resistance element 45, and lead 45*b*. Therefore a current according to the resistance values of bearing 440 and resistance element 45 flows to the ground.

Thus, the high voltage is not applied to the metal portions near registration roller 24 and pressure roller 25, causing no current flow or electric discharge. Hence, the toner forming the toner image on photosensitive drum 14 does not fly by static electricity, which allows the toner image to be favorably transferred onto sheet P. As a result, the image quality is not degraded. Moreover, since no high voltage is applied to electronic components existing near pressure roller 25, printer Pr does not break.

Subsequently, once the tailing edge of sheet P leaves registration roller 24 and pressure roller 25, pressure roller 25 is pressed against registration roller 24 by the bias force of spring 143.

When pressure roller 25 is pressed against registration roller 24, bearing holder 441 also moves along with pressure roller 25 in the same direction by a distance equal to the thickness of sheet P. In this event, since torsion spring 302 is attached to spring attachment portion 301, there is no change in the positional relation between free end 316 at first arm portion 312 (FIG. 10) and bearing 440 for pressure roller 25. Thus, regardless of the thickness of sheet P, torsion spring 302 is in contact with bearing 440 with a constant bias force.

As described above, in this embodiment, pressure roller 25, bearing 440, and torsion spring 302 are all made of a conductive metal material, and torsion spring 302 is in contact with bearing 440 at its one end, and is fixed by screw 47 at the other end. Thus, pressure roller 23 can be pressed against registration roller 22 with stable press force F2 regardless of the thickness of sheet P. Also, pressure roller 25 can be grounded.

Moreover, torsion spring 302 is attached to spring attachment portion 301 by fitting coil portion 311 around boss portion 321 of spring attachment portion 301. Boss portion 321 is provided such that its center cn1 is located at a predetermined distance away from the virtual straight line connecting shaft center sh1 of pressure roller 25 and center cn2 of screw 47. Thus, even if bearing holder 441 moves along with pressure roller 25, torsion spring 302 sufficiently flexes. Hence, no excessive stress is applied to screw 47.

Since torsion spring 302 is in contact with bearing 440 and is not in direct contact with pressure roller 25, wear resistance of pressure roller 25 and torsion spring 302 can be improved.

Although first and second roller conveyance mechanisms 11, 113 are described in the first and second embodiments, the invention can also be applied to other roller conveyance mechanisms that include a pair of rollers.

In addition, although printer Pr is taken as an example and described in the above embodiments, the invention can also be applied to other types of image formation apparatuses such as a copier, a facsimile machine, and a multifunctional machine.

It should be noted that the invention is not limited to the above embodiments, and can be variously modified based on the gist of the invention, and such modifications are included in the scope of the invention, as well.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A medium conveyance device, comprising:

a pressed member;

a first retention member retaining the pressed member and including a first bias-member retention portion;

a press member provided facing the pressed member;

a second retention member being provided movable relative to the first retention member and retaining the press member, the second retention member including a second bias-member retention portion; and a bias member provided between the first bias-member retention portion and the second bias-member retention portion and supported at one end thereof by the first bias-member retention portion and at another end thereof by the second bias-member retention portion, thereby pressing the press member against the pressed member, wherein the first retention member includes a pressed-member support portion supporting the pressed member, the second retention member includes a press-member support portion supporting the press member, and the pressed-member support portion is located between the press-member support portion and the first bias-member retention portion.

2. The medium conveyance device according to claim 1, wherein the pressed member is a roller.

3. The medium conveyance device according to claim 1, wherein the press member is a roller.

4. The medium conveyance device according to claim 1, wherein the pressed member is a drive roller.

5. The medium conveyance device according to claim 4, wherein the press member is a driven roller.

6. The medium conveyance device according to claim 1, wherein the bias member is provided in a compressed state between the first and second bias-member retention portions.

7. The medium conveyance device according to claim 1, wherein the pressed member is supported by the pressed-member support portion of the first retention member via a first support member, and the press member is supported by the press-member support portion of the second retention member via a second support member.

8. The medium conveyance device according to claim 7, wherein the device further comprises a conductive member and a fixture member, the press member and the second support member are made of a conductive material, the conductive member has one end in contact with the second support member and another end fixed by the fixture member, and the press member is grounded via the second support member, the conductive member, and the fixture member.

9. The medium conveyance device according to claim 8, wherein the conductive member is attached to a conductive-member support portion formed in the second retention member.

10. The medium conveyance device according to claim 9, wherein the conductive member is a torsion spring having a coil portion, the torsion spring is attached to the conductive-member support portion by fitting a boss portion of the conductive-member support portion into the coil portion of the torsion spring, and a center of the boss portion is located at a predetermined distance away from a straight line connecting a shaft center of the press member and a center of the fixture member.

11. The medium conveyance device according to claim 1, wherein the pressed member is in contact with the press member at a contact portion, a distance between the contact portion and the second retention member is greater than a distance between the contact portion and the first retention member, and the bias member is a compressed spring.

12. An image formation apparatus comprising the medium conveyance device according to claim 1.

13. A medium conveyance device, comprising:

a pressed member;

a first retention member retaining the pressed member and including a first bias-member retention portion;

a press member provided facing the pressed member;

a second retention member being provided movable relative to the first retention member and retaining the press member, the second retention member including a second bias-member retention portion; and a bias member is provided in a compressed state between the first bias-member retention portion and the second bias-member retention portion and supported at one end thereof by the first bias-member retention portion and at another end thereof by the second bias-member retention portion, thereby pressing the press member against the pressed member in a first direction, wherein the second bias-member retention portion is provided downstream of the first bias-member retention portion in a second direction substantially parallel to the first direction.

14. The medium conveyance device according to claim 13, wherein the pressed member comprises a first roller having a first axis, wherein the press member comprises a second roller having a second axis, and wherein the first axis is provided between the second axis and the bias member.

15. The medium conveyance device according to claim 13, further comprising:

a conductive member; and a fixture member, wherein the press member is made of a conductive material, wherein the conductive member has one end electrically connected with the press member and another end electrically connected with the fixture member, and wherein the press member is grounded via the conductive member and the fixture member.

16. The medium conveyance device according to claim 13, wherein the pressed member is a roller.

17. The medium conveyance device according to claim 13, wherein the press member is a roller.

18. The medium conveyance device according to claim 13, wherein the pressed member is a drive roller.

19. The medium conveyance device according to claim 18, wherein the press member is a driven roller.

20. An image formation apparatus comprising the medium conveyance device according to claim 13.

* * * * *